United States Patent [19]

Ritchie

[11] 3,989,421

[45] Nov. 2, 1976

[54] HOUSING CONSTRUCTION FOR SLANT AXIS ROTARY MECHANISM

[75] Inventor: James A. Ritchie, Peoria, Ill.

[73] Assignee: Caterpillar Tractor Co., Peoria, Ill.

[22] Filed: Aug. 6, 1975

[21] Appl. No.: 601,890

[52] U.S. Cl. ..... 418/53; 418/83; 418/178

[51] Int. Cl.[2] ..... F01C 1/02; F01C 21/06; F04C 17/02; F04C 29/04

[58] Field of Search ..... 418/68, 49–53, 418/178, 219, 83; 73/253, 255, 258

[56] References Cited

UNITED STATES PATENTS

| | | | |
|---|---|---|---|
| 1,638,183 | 9/1927 | Bylger | 418/51 |
| 2,244,539 | 6/1941 | Krueger | 418/50 |
| 3,102,516 | 9/1963 | Gist et al. | 418/83 |
| 3,156,221 | 11/1964 | Miller | 418/68 |
| 3,239,135 | 3/1966 | Fritz | 418/83 |
| 3,485,218 | 12/1969 | Clarke | 418/53 |
| 3,545,899 | 12/1970 | Clarke | 418/68 |

FOREIGN PATENTS OR APPLICATIONS

| | | | |
|---|---|---|---|
| 313,575 | 10/1903 | France | 73/258 |

*Primary Examiner*—John J. Vrablik
*Attorney, Agent, or Firm*—Wegner, Stellman, McCord, Wiles & Wood

[57] ABSTRACT

A slant axis rotary mechanism such as an engine, pump, or the like. The mechanism includes a shaft having an angularly off-set portion journalling a rotor thereon. The rotor has a peripheral flange with a plurality of apices on each side of the flange. The mechanism further includes a housing defining an operating chamber receiving the rotor and including an outer spherical peripheral wall adapted to be sealingly engaged by a seal carried by the periphery of the flange. The housing also includes spaced, generally radially extending side walls adapted to be sealingly engaged by seals carried by the rotor apices. According to the invention, the housing is defined by a pair of housing segments flanking the rotor, each segment having one of the radially extending side walls formed therein. A liner having a spherical inner surface defining the outer spherical peripheral wall is clamped between the housing segments.

4 Claims, 3 Drawing Figures

HOUSING CONSTRUCTION FOR SLANT AXIS ROTARY MECHANISM

BACKGROUND OF THE INVENTION

This invention relates to slant axis rotary mechanisms for use as engines, pumps, compressors, or the like. More particularly, this invention relates to improved housing constructions for such engines.

The formation of housings for slant axis rotary mechanisms is difficult, particularly in four-cycle mechanisms, because the surfaces are not cylindrical. The general desire in the formation of mechanisms of this type to have scratch marks formed during the machining operations oriented at approximately 90° to the direction of seal travel provides a further difficulty. Because of this desire, the side walls of the housings must be machined in a generally radial direction. The need for relatively sharp corners at the interface of the side walls and the inner or outer peripheral spherical wall in such mechanisms, provides a further difficulty. If the corners are not kept sharp, difficulties in sealing the mechanism will take place. Lastly, it is highly desirable that the number of elements forming the housing be kept at a minimum to eliminate leakage paths and for the sake of general economy.

SUMMARY OF THE INVENTION

It is the principal object of the invention to provide a new and improved slant axis rotary mechanism. More specifically, it is an object of the invention to provide a new and improved housing for a slant axis rotary mechanism.

The exemplary embodiment of the invention achieves the foregoing object in a structure including a shaft having an angularly offset portion journalling a rotor. The housing of the invention defines an operating chamber receiving the rotor and includes an outer spherical peripheral wall adapted to be sealingly engaged by seals carried by the usual rotor flange and, specifically, by the periphery thereof. The housing also includes the usual spaced, generally radially extending side walls which are adapted to be sealingly engaged by seals carried by the conventional rotor apices. According to the invention, the housing is defined by a pair of housing segments flanking the rotor, each segment having one of the radially extending side walls formed therein. A liner having a spherical inner surface defining the outer spherical peripheral wall is clamped between the housing segments. This construction permits the formation of a sharp corner at the interface of the liner and each housing segment. In addition, in forming the segment, the width of the liner provides a distance past the intended point of interface of the housing segment and the liner for movement of a tool so that the side walls may be machined in a radial direction.

According to a highly preferred embodiment, each segment includes a peripheral groove at the outermost extremity of the associated radially extending side wall and the liner is partly received in the grooves. The housing segments may also be formed with annular shoulders backing the liner. When the mechanism is employed as an engine, or as some other mechanism requiring cooling, the annular shoulders may be provided with radially inwardly opening grooves defining, in connection with the liner, coolant passages.

According to a highly preferred embodiment of the invention, each groove formed in a housing segment has a radially inner surface of generally cylindrical configuration and a radially outer surface of ramp like configuration so that the portions of the liner received in the grooves are crushed. In a highly preferred embodiment, the radially inner surface of each edge of the liner is generally of cylindrical configuration to mate with the radially inner groove surfaces so that the greatest stress will occur at the outer diameter of the liner to avoid localized bulging and yet insure gas tightness.

Other objects and advantages will become apparent from the following specification taken in connection with the accompanying drawings.

DESCRIPTION OF THE PREFERRED EMBODIMENTS

Figure 1:
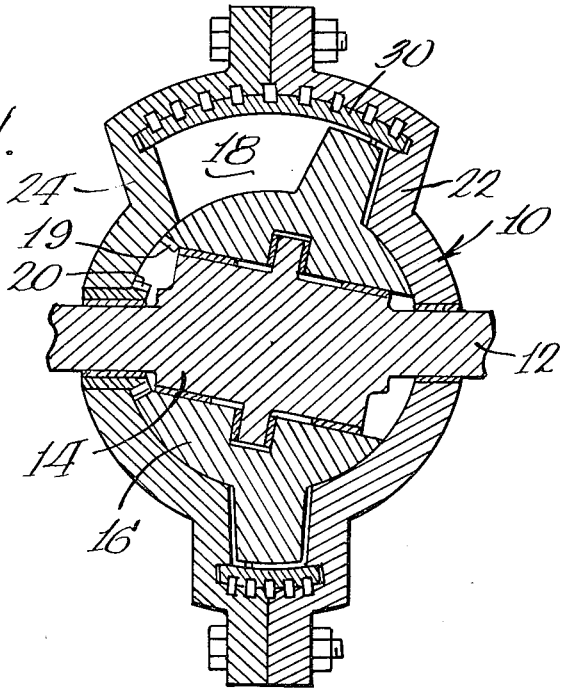
FIG. 1 is a sectional view of a slant axis rotary mechanism made according to the invention.

An exemplary embodiment of a slant axis rotary mechanism made according to the invention is illustrated in FIG. 1 and is seen to include a housing, generally designated 10, journalling a shaft 12. The shaft 12 includes an angularly offset portion 14 which, in turn, journals a rotor 16 within an operating chamber 18 defined by the housing 10. The rotor 16 carries an internal ring gear 19 in mesh with a stationary gear 20 affixed to the housing 10 to establish proper timing between the rotor 16 and the shaft 12.

Figure 2:
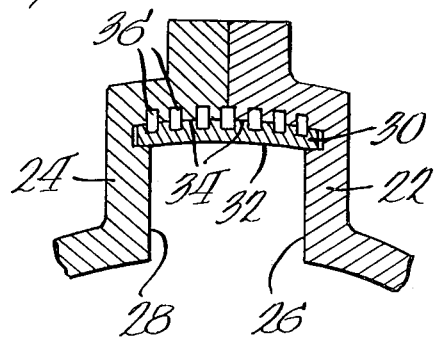
FIG. 2 is a fragmentary section of a portion of the housing of the slant axis rotary mechanism.

FIG. 2 illustrates the housing of the present invention. Specifically, the housing 10 is comprised of a housing segment 22 and a housing segment 24 which may be clamped together by any suitable means. The housing segment 22 has formed therein one of the generally radially extending side walls 26 defining the operating chamber of the mechanism while the housing segment 24 carries a similar side wall 28. Those skilled in the art will recognize that the side walls 26 and 28 do not extend truly radially, but, depending upon the specific usage of the engine, may be conical or conical and sinusoidal or, in some cases, simply angularly related to the axis of the shaft 12.

A linear 30 is clamped between the housing segments 22, 24 as illustrated in FIG. 2 and includes a radially inner surface 32 of generally spherical configuration. It will be observed from FIG. 2 that at the interface of the liner 32 and the housing segments 22 and 24, sharp corners result. It will also be appreciated that during formation of the housing segments 22 and 24, with the liner 30 removed, a distance equal to the thickness of the liner 30 is available for movement of a machine tool to thereby machine the side walls 26 and 28 in a generally radial direction so that the apex seals will move thereon in a direction approximately 90° thereto.

Each of the housing segments 22 and 24 is provided with an annular shoulder 34 which serves to back the liner 32 and support the same when under high operating pressures. If the mechanism is to be used as an engine or for some other purpose wherein cooling is required, the shoulders 34 may be provided with radially inwardly opening grooves 36 for receipt of a coolant. Where extremely high cooling capacity or efficient cooling capacity is desired, similar grooves 38 may be formed in the radially outer surface of the liner 30 as illustrated in FIG. 3.

Figure 3:
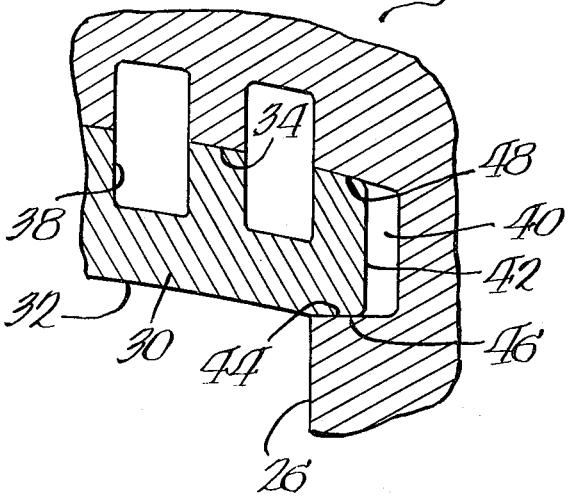
FIG. 3 is an enlarged, fragmentary section of the housing.

FIG. 3 also illustrates a preferred means by which the liner 30 is clamped between the two housing segments 22 and 24. Specifically, each segment 26 and 28 includes a peripheral groove 40 at the outermost extremity of the associated radially extending side wall. The grooves 40 receive corresponding edges 42 of the liner 30. Preferably, the radially inner surface 44 of the groove 40 is of cylindrical configuration and the radially inner surface 46 of the edge 42 of the liner 30 has a similar, mating cylindrical configuration.

Conversely, the radially outer surface 48 of the groove has a ramp-like configuration such that the groove 40 progressively widens from bottom to top. In addition, it is preferable that the thickness of the liner 30 be slightly greater than the distance between the walls 44 and 48 of the groove 40. Consequently, as the liner is clamped into position, its ends 42 are crushed to some extent. Preferably, the internal surface 32 of the liner is hard surfaced as, by chrome plating, not only at the spherical surface, but at the cylindrical surface as well. This arrangement avoids bulging at the interface of the side wall 26 and the outer peripheral wall 32. Moreover, by reason of the use of the cylindrical surfaces 44 and 46, the greatest degree of crushing takes place primarily on the outer dimension of the liner to minimize distortion of the spherical surface 32. Preferably, a slight interference fit is employed so that intimate contact is generated between the liner 30 and the annular shoulder 34 to enhance heat transfer, and to prevent chattering and fretting.

The thickness of the liner 30 may be varied to suit the particular use employed. Thin liners may be slightly deformed to allow initial installation of the rotor therein prior to the clamping of the liner 30 between the housing segments 22 and 24. However, the use of thin liners minimizes the area available for a machining tool in the area of the grooves 40 necessary to produce radial machine marks on the side walls 26 and 28. Where it is absolutely necessary to have such radially extending machine marks on the side walls 26 and 28, a thick liner 30 may be employed to provide sufficient relief at the radially outer extremity of the side walls 26 and 28 to accomplish appropriate machining. In such cases, the liner may be split in a manner similar to the splitting of connecting rod bearing shells to receive the rotor.

From the foregoing, it will be appreciated that a slant axis rotary mechanism made according to the invention minimizes the number of housing parts employed, thereby providing for economy in the manufacturing operation and minimizing the number of possible leakage paths. Moreover, the configuration of the parts allows sharp corners at the interface of side walls in the peripheral outer wall to maximize sealing. Finally, the unique construction enables machining of the side walls of the operating chamber in a radial direction to thereby be at approximately 90° to the direction of seal travel to thereby increase the life of seals and, accordingly, the life of the mechanism.

What is claimed is:

1. In a slant axis rotary mechanism including, a shaft having an angularly offset portion, a rotor journalled on said angularly offset portion, a rotor journalled on said angularly offset portion, said rotor having a peripheral flange with plural apices on each side of the flange, and a housing defining an operating chamber receiving said rotor and including an outer, spherical peripheral wall adapted to be sealingly engaged by sealing means carried by the periphery of said flange, and spaced, generally radially extending side walls adapted to be sealingly engaged by seals carried by said rotor apices, the improvement wherein said housing is defined by a pair of housing segments flanking said rotor, each segment having one of said radially extending side walls formed therein, and a liner having a spherical inner surface defining said outer spherical peripheral wall clamped between and backed by said housing segments, each said segment including a peripheral groove at the outermost extremity of the associated radially extending side wall, said liner being partly received in said grooves, said housing segments further including annular shoulders backing said liner.

2. The slant axis rotary mechanism of claim 1 wherein said annular shoulders include radially inwardly opening grooves defining, with said liner, coolant passages.

3. The slant axis rotary mechanism of claim 1 wherein each said groove has a radially inner surface of generally cylindrical configuration, and a radially outer surface of ramp-like configuration, whereby the portion of said liner received in said grooves are crushed.

4. The slant axis rotary mechanism of claim 3 wherein the radially inner surface of each edge of said liner is of generally cylindrical configuration to mate with said radially inner groove surfaces.

* * * * *